US005351061A

United States Patent [19]

Madaus et al.

[11] Patent Number: 5,351,061

[45] Date of Patent: Sep. 27, 1994

[54] ANTENNA WITH PARABOLIC REFLECTOR

[75] Inventors: Batto Madaus, Burgwedel; Horst Antony, Wietze; Bernd Anger, Holle; Paul Thiele, Laatzen, all of Fed. Rep. of Germany

[73] Assignee: kabelmetal electro Gesellschaft mit beschränkter Haftung, Hanover, Fed. Rep. of Germany

[21] Appl. No.: 90,362

[22] Filed: Jul. 9, 1993

Related U.S. Application Data

[63] Continuation of Ser. No. 785,322, Oct. 28, 1991, abandoned.

[30] Foreign Application Priority Data

Oct. 28, 1991 [DE] Fed. Rep. of Germany ..... 9014875

[51] Int. Cl.[5] ..... H01Q 19/12

[52] U.S. Cl. ..... 343/840; 343/878

[58] Field of Search ..... 343/840, 878, 879, 772, 343/775, 784; H01Q 19/12, 1/12

[56] References Cited

U.S. PATENT DOCUMENTS 3,550,135 12/1970 Bodmer ..... 343/840
3,623,115 11/1971 Schuttloffel ..... 343/840
3,653,055 3/1972 Wu et al. ..... 343/840
4,231,000 10/1980 Schuegraf ..... 343/858
4,340,892 7/1982 Brunner et al. ..... 343/771
4,365,252 12/1982 Hubert ..... 343/766
4,860,021 8/1989 Kurosawa et al. ..... 343/840

FOREIGN PATENT DOCUMENTS 3241890 2/1989 Fed. Rep. of Germany .

*Primary Examiner*—Donald Hajec
*Assistant Examiner*—Hoanganh Le
*Attorney, Agent, or Firm*—Martin A. Farber

[57] ABSTRACT

An antenna has a parabolic reflector and a tubular exciter which is provided for illuminating the reflector. At least one waveguide supports the exciter and connects electrically to the exciter for the guidance of electromagnetic waves to the exciter. A mount serving for mounting and stabilizing the reflector has an extension which extends radially beyond the edge of the reflector and has a support arm which is bent in a direction towards a front side of the reflector and extends forward beyond it. A waveguide bearing the exciter is fastened to the support arm.

11 Claims, 2 Drawing Sheets

ANTENNA WITH PARABOLIC REFLECTOR

RELATED APPLICATION

This application is a continuation of my co-pending application Ser. No. 07/785,322 filed Oct. 28, 1991, now abandoned.

FIELD AND BACKGROUND OF THE INVENTION

The present invention relates to an antenna having a parabolic reflector and a tubular exciter provided for the illumination thereof, to which exciter there is connected at least one wave guide bearing the exciter for a conducting of electromagnetic waves. A mechanically stable mount is provided on a rear side of the reflector facing away from the exciter in order to hold it fast on a support (German Patent 32 41 890).

Antennas with parabolic reflectors are used, for instance, for radio link or satellite radio systems. In this connection, they can be used for a direct illumination of the reflector or also for the illumination thereof by a subreflector (Cassegrain principle). "Illumination", in this connection, is intended to cover both directions of transmission of the electromagnetic waves and, therefore, both waves to be sent out and waves to be received. For the illumination there are used, for instance, tube-less exciters which are arranged on the free end of a feed line.

In the antenna in accordance with the aforementioned German Patent 32 41 890, the feed line consists of two rectangular wave guides which at the end thereof facing away from the exciter are fastened by a holding plate centrally in the reflector. The feed line and the exciter together are of considerable weight so that the holding plate must be made very stable and be held very firmly in the reflector so that the predetermined position of the exciter can be retained. In order to secure this position, in most cases additional clamping elements are arranged on the exciter, they being held fast on the end of the reflector. Since, furthermore, the feed line which consists of the two wave guides must be accurately shaped, as a whole a considerable expense results for the manufacture of a complete antenna.

SUMMARY OF THE INVENTION

It is an object of the invention so to develop the above-mentioned antenna that its construction, including the holding of the exciter, is considerably simplified.

According to the invention, the mount (e.g. 2) has an extension which extends beyond the edge of the reflector (1) and has a support arm (e.g. 7) which is bent in the direction towards the front side of the reflector and extends forwards beyond same; and the wave guide (e.g. 5, 6) which bears the exciter (e.g. 4) is fastened on the support arm.

In the antenna of the invention, the mount which is in any event present and which serves for fastening the reflector to a mast and for a stable mounting of the reflector is utilized simultaneously to fix the waveguide bearing the exciter in position. For this purpose, the mount need be extended only at one place beyond an edge of the reflector and be provided with the support arm. The exciter itself, furthermore, is born by the waveguide which can be fastened in particularly simple manner to the support arm. Therefore, no special shaping of the waveguide is necessary, and it can be linear. Since the mounting of the exciter in this way is effected on the outside around the reflector, the latter can also be made of simpler shape. In particular, no central opening to receive a holding plate is required any longer in the reflector.

According to another feature of the invention, the support arm (7) is arranged parallel to the axis (A) of the reflector (1).

Further according to a feature of the invention, the support arm (7) is fork-shaped at its free end in order to receive one or more waveguides (5, 6).

BRIEF DESCRIPTION OF THE DRAWINGS

With the above and other objects and advantages in view, the present invention will become more clearly understood in connection with the detailed description of a preferred embodiment when considered with the accompanying drawings, of which.

DETAILED DESCRIPTION OF THE PREFERRED EMBODIMENT

Figure 1:
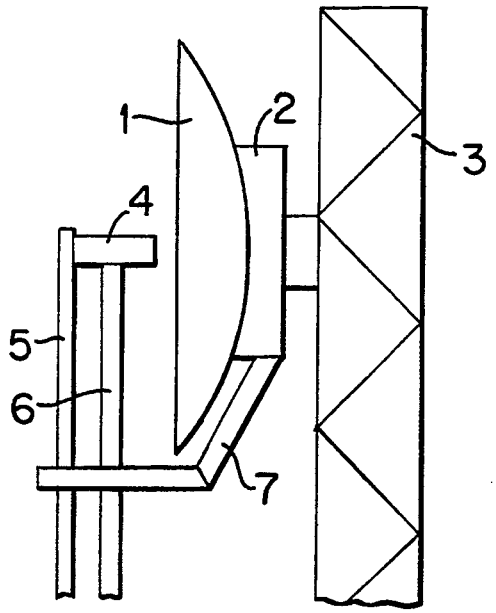
FIG. 1 is a diagrammatic view of an antenna in accordance with the invention.

An antenna for transmitting two linearly polarized waves which are perpendicular to each other is shown in the drawing. For this purpose, two waveguides are connected to the exciter. The invention can also be employed if only one wave or more than two waves are to be transmitted. In such case, only one waveguide or more than two waveguides bear the exciter and connect to the exciter.

From the diagrammatic showing in FIG. 1, there can be noted a parabolic reflector 1 of an antenna which is fastened via a mount 2 to a mast 3. The reflector I is illuminated by a tubular exciter 4 to which there are connected two waveguides 5 and 6 which hold the exciter 4 in its position. In this position, an opening of the exciter 4 facing the reflector 1 lies at the focal point of the reflector. The waveguides 5 and 6 are fastened on a support arm 7 which is preferably formed as a one-piece construction with the mount 2. The construction of the exciter 4 and the shape of the waveguides 5 and 6 are basically known. They are, therefore, not described here.

Figure 2:
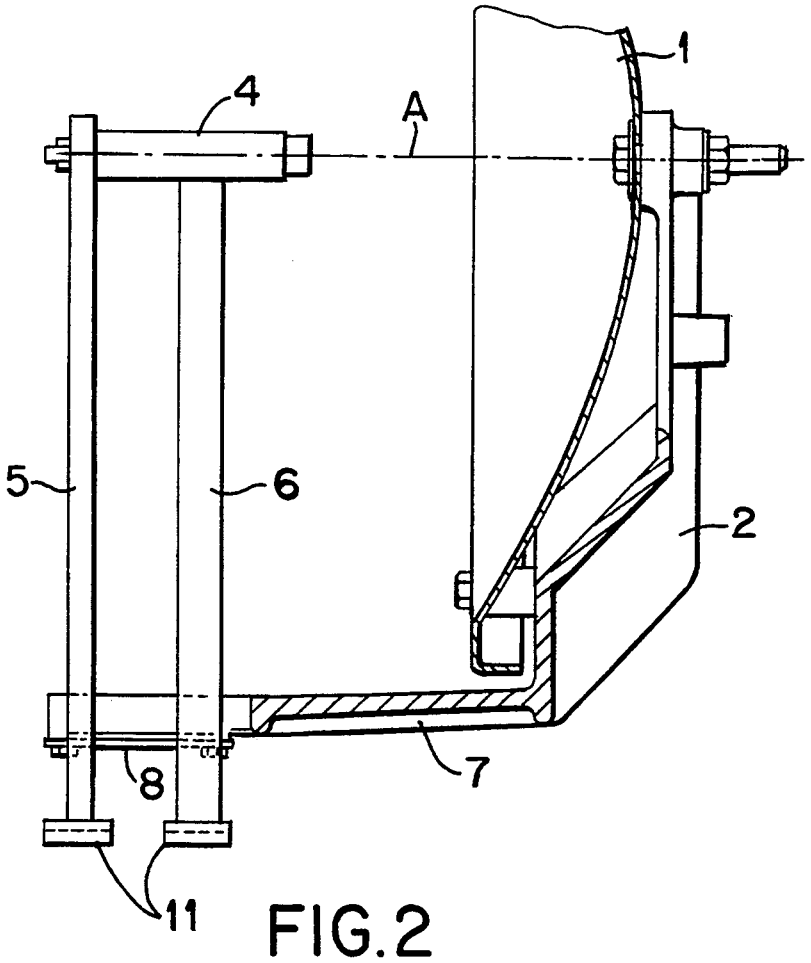
FIG. 2 shows a portion of the antenna on a larger scale.
Figure 3:
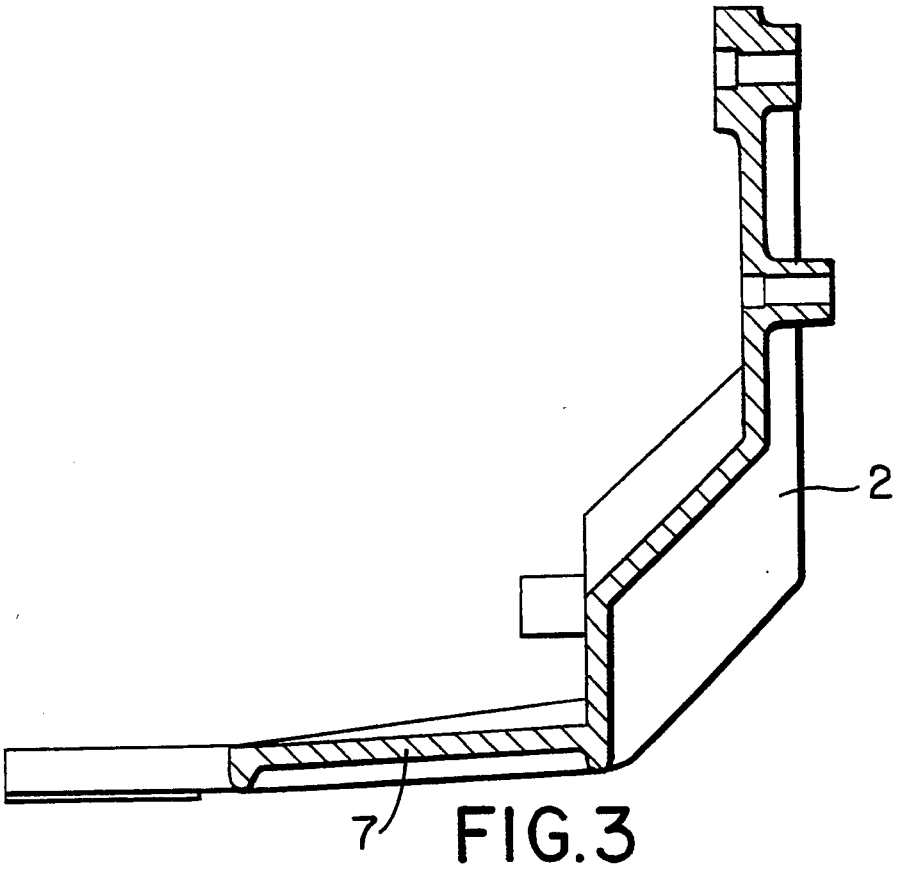
FIGS. 3 and 4 show an individual part of the antenna, also on a larger scale.
Figure 4:
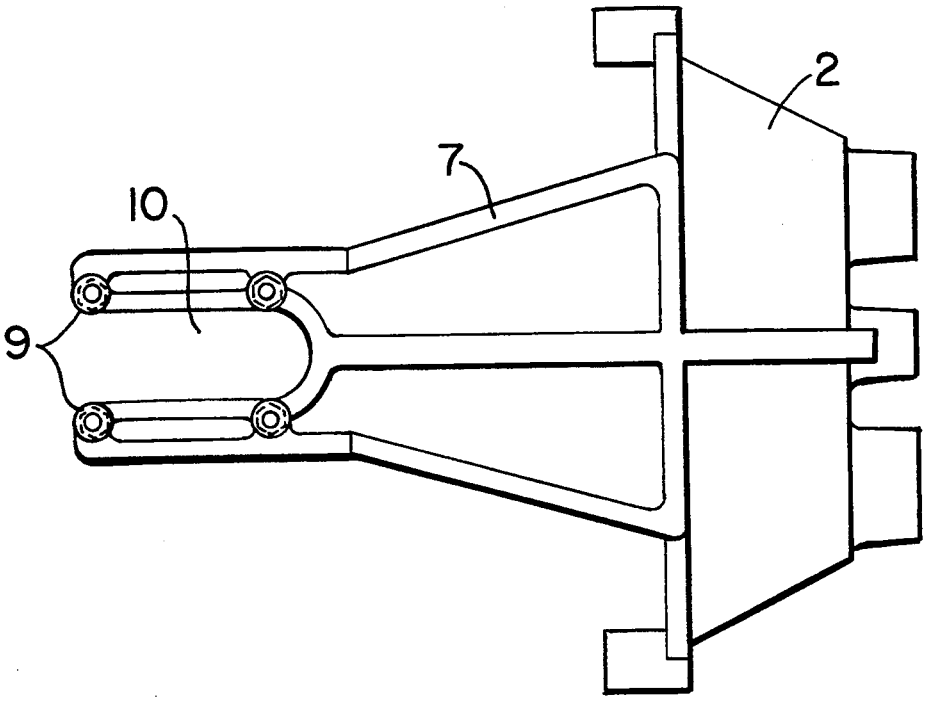

The mount 2 can be seen in enlarged views in FIGS. 2 to 4. It consists, for instance, of aluminum and can be developed as a casting. The mount 2 is mounted on the rear of the reflector 1 upon the manufacture of the antenna. It serves in this connection simultaneously to stabilize the reflector 1 and to attach it to the mast 3 or to some other sufficiently firm support.

The mount 2 shown as individual part in FIG. 3 is so extended in radial direction at one point of the circumference of the reflector 1, that it extends to beyond the edge of the reflector, as can be noted from FIG. 2. On this extension of the mount 2 there is located the support arm 7 which is bent in a direction towards the front side of the reflector 1. In a preferred embodiment, the support arm 7 is approximately parallel to the central axis A of the reflector 1 on which the exciter 4 also lies. However, it can, in principle, extend in any suitable direction and, therefore, may be oblique to the axis A if desired.

The two waveguides 5 and 6, which are developed with linear form in the preferred embodiment, bear the exciter 4. The two waveguides are firmly attached to the exciter also for secure electrical connection. On the opposite end, distant from the exciter, each of the two waveguides 5 and 6 are fastened on the support arm 7. For this purpose, a plate 8 to be connected to the support arm 7, can be employed. The plate 8 is screwed, for instance, at points 9 to the support arm 7. The waveguides 5 and 6 can be fastened to the plate 8 as a prefabrication.

For the simple application of the two waveguides 5 and 6 to the support arm 7, the latter, as shown in FIG. 4, can be developed in fork shape at its free end so that a recess 10 which is open at one side results. The two waveguides 5 and 6 can then be inserted, together with the plate 8, into the recess 10 from its open side. In the end position the plate 8 is screwed to the support arm 7.

The waveguides 5 and 6 can be terminated at their free ends by flanges 11 to which further waveguides (not shown) can be connected.

We claim:

1. An antenna comprising:

a parabolic reflector and a tubular exciter for illuminating said reflector;

at least one waveguide connected to said exciter and supporting said exciter for conducting electromagnetic waves to or from said exciter;

a mechanically stable mount supporting said reflector and located on a rear side of said reflector facing away from said exciter;

wherein said mount has an extension which extends beyond an edge of said reflector in generally transverse attitude to a central axis of said reflector, and a support arm of generally planar configuration which extends in a forward direction from said extension towards a front side of said reflector and beyond said reflector, said support arm being distant from said exciter, said at least one waveguide extends in a generally transverse direction of said support arm and is fastened to said support arm at an end thereof distant from said mount, said mount being of one-piece construction for supporting said reflector and said at least one waveguide; and a width of said generally planar support arm tapers from a maximum width at said mount extension to a minimum width at said one waveguide.

2. An antenna according to claim 1, wherein said support arm is arranged parallel to a central axis of said reflector.

3. An antenna according to claim 2, wherein said support arm has a free end distant from said mount, said free end being fork-shaped in order to receive said at least one waveguide.

4. An antenna according to claim 1, wherein said support arm has a free end distant from said mount, said free end being fork-shaped in order to receive said at least one waveguide.

5. An antenna according to claim 1, wherein said at least one waveguide is linear.

6. An antenna according to claim 1, wherein said support arm has an elongated shape.

7. An antenna comprising:

a reflector, and an exciter positioned in front of the reflector for illuminating the reflector;

at least one waveguide connected to said exciter for supporting said exciter in front of said reflector, said at least one waveguide serving to conduct electromagnetic waves to or from said exciter;

a mount connected with a back side of said reflector for securing said antenna to a mast; and wherein said mount includes a support arm of generally planar configuration extending past said reflector and forward of said reflector to engage and position said at least one waveguide, said support arm is distant from said exciter, and said one waveguide extends in a generally transverse direction of said support arm;

a rear portion of said mount connects with said support arm and is configured for enveloping a back side of said reflector to stabilize the reflector, said mount being of one-piece construction for supporting said reflector and said at least one waveguide; and a width of said generally planar support arm tapers from a maximum width at said rear portion of said mount to a minimum width distant from said rear portion of said mount.

8. An antenna according to claim 7, further comprising a plate extending from said at least one waveguide, and wherein an end of said support arm is configured for receiving said plate to secure said at least one waveguide to said support arm.

9. An antenna according to claim 8, wherein said end of said support arm is forked to provide a recess for receiving said at least one waveguide and said plate.

10. An antenna according to claim 7, wherein said at least one waveguide is linear.

11. An antenna according to claim 7, wherein said support arm has an elongated shape.

* * * * *